US009308658B2

(12) United States Patent
Coviello

(10) Patent No.: US 9,308,658 B2
(45) Date of Patent: Apr. 12, 2016

(54) ARTICULATING HANDHELD RAZOR TOOL

(71) Applicant: Christopher Coviello, Yorklyn, DE (US)

(72) Inventor: Christopher Coviello, Yorklyn, DE (US)

(73) Assignee: Project Razor LLC, Newark, DE (US)

( * ) Notice: Subject to any disclaimer, the term of this patent is extended or adjusted under 35 U.S.C. 154(b) by 283 days.

(21) Appl. No.: 13/798,283

(22) Filed: Mar. 13, 2013

(65) Prior Publication Data

US 2014/0190013 A1 Jul. 10, 2014

Related U.S. Application Data

(60) Provisional application No. 61/750,690, filed on Jan. 9, 2013.

(51) Int. Cl.
*B26B 21/40* (2006.01)
*B26B 21/52* (2006.01)

(52) U.S. Cl.
CPC ..... *B26B 21/4062* (2013.01); *B26B 21/4081* (2013.01); *B26B 21/523* (2013.01)

(58) Field of Classification Search
CPC ..... B26B 21/523; B26B 21/52; B26B 19/00
USPC ..... 30/44–539
See application file for complete search history.

(56) References Cited

U.S. PATENT DOCUMENTS

| | | | | |
|---|---|---|---|---|
| 955,314 | A * | 4/1910 | Borne | 403/96 |
| 3,245,445 | A * | 4/1966 | Herman et al. | 30/501 |
| 4,461,078 | A * | 7/1984 | Carreker | B26B 21/40 30/47 |
| 5,027,511 | A * | 7/1991 | Miller | 30/526 |
| 5,167,069 | A | 12/1992 | Quinn | |
| 6,018,877 | A * | 2/2000 | Greene | B26B 1/222 30/298 |
| 6,189,222 | B1 | 2/2001 | Doyle | |
| 6,560,876 | B2 * | 5/2003 | Carr | B26B 21/222 30/34.1 |
| 7,093,363 | B1 * | 8/2006 | Kuo | 30/47 |
| 7,103,980 | B2 | 9/2006 | Leventhal | |
| 7,140,115 | B2 * | 11/2006 | Greene | 30/526 |
| 7,200,942 | B2 * | 4/2007 | Richard | 30/526 |
| D605,362 | S * | 12/2009 | Andersen | D28/48 |
| D623,800 | S * | 9/2010 | Clemons | D28/46 |
| 7,856,725 | B2 | 12/2010 | Marut | |
| 2002/0050065 | A1 * | 5/2002 | Kludjian et al. | 30/50 |
| 2003/0177648 | A1 | 9/2003 | Zeiter | |
| 2004/0107585 | A1 * | 6/2004 | Helmrich | B26B 19/38 30/537 |
| 2004/0139615 | A1 * | 7/2004 | Gianatasio | 30/233 |
| 2011/0308089 | A1 * | 12/2011 | Bridges | 30/77 |
| 2012/0145730 | A1 * | 6/2012 | Bloom | 220/729 |
| 2012/0291295 | A1 | 11/2012 | Braun | |

* cited by examiner

*Primary Examiner* — Ned Landrum
*Assistant Examiner* — Liang Dong
(74) *Attorney, Agent, or Firm* — Panitch Schwarze Bellsario & Nadel LLP

(57) ABSTRACT

Articulating or convertible handheld razor tools include an articulating handle portion, a razor body portion, and a blade mounting bracket. The articulating handle portion includes an arm section and an extender element movably coupled to the arm section. The razor body portion includes a recess for positioning of the articulating handle portion and a mounting area. The mounting area is configured to hold one or more razor cartridges for shaving. In one configuration, the articulating handheld razor tool incorporates a skid plate and a level, or alternatively a roller, into the razor body portion to better facilitate shaving various body surface profiles, e.g., the face and/or scalp, by a single user.

17 Claims, 14 Drawing Sheets

ARTICULATING HANDHELD RAZOR TOOL

CROSS-REFERENCE TO RELATED APPLICATION

This application claims priority to Provisional Patent Application Ser. No. 61/750,690, filed Jan. 9, 2013. The aforementioned priority application is incorporated herein by reference in its entirety.

BACKGROUND

1. Field of the Invention

The field of the present invention relates generally to razor tools, and particularly razor tools with a first configuration used to position one or more razor blades against one body surface (e.g., face) that are articulable to a second configuration used to position one or more razor blades against a different body surface (e.g., scalp).

2. Background

Razors are some of the most widely used personal care products. Because hair removal is considered a must for many, especially in Western cultures, razors are manufactured and sold in many forms to accommodate various user needs. Shaving razors remove hair from body surfaces with various profiles. Users often select different razor tools of different shapes and forms to sufficiently shave various body surfaces.

Many users have different shaving needs, depending on the body surface they want shaved. Users wanting shaved heads, for example, often have one type of razor tool for the scalp and another type of razor tool for their face. Those who shave their own scalp have particular need for a razor tool configured for such purpose to prevent or limit gouging or cutting skin.

Considering the inconveniences encountered by users wanting shaved heads and other users who shave irregularly profiled body surfaces, there is a need for a razor tool that accommodates body surfaces of various profiles. There is a further need for an improved razor tool that can facilitate user positioning of one or more razor blades to remove hair from either the face or the scalp. The present invention fulfills these needs and provides further related advantages as outlined in the following summary.

SUMMARY

The configurations of articulating or converting handheld razor tools disclosed herein include an articulating handle portion, a razor body portion, and a blade mounting bracket. The articulating handle portion includes an arm section and an extender element coupled to the arm section. The razor body portion includes a recess for positioning of the articulating handle portion and a mounting area. The mounting area is configured to hold one or more razor blade mounts, which include one or more razor cartridges with blades. In one configuration, an articulating handheld razor tool incorporates various elements to facilitate self-shaving of various body surfaces, e.g., the face and scalp, by a single user. These elements include, for example, a skid plate and/or an optional level incorporated into the razor body portion. In another configuration, a scalp roller is used as an alternative to the skid plate.

A more complete understanding of various configurations of the articulating or converting handheld razor tools will be afforded to those skilled in the art, as well as a realization of additional advantages and objects thereof, by consideration of the following detailed description. Reference will be made to the appended sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION

Figure 1:
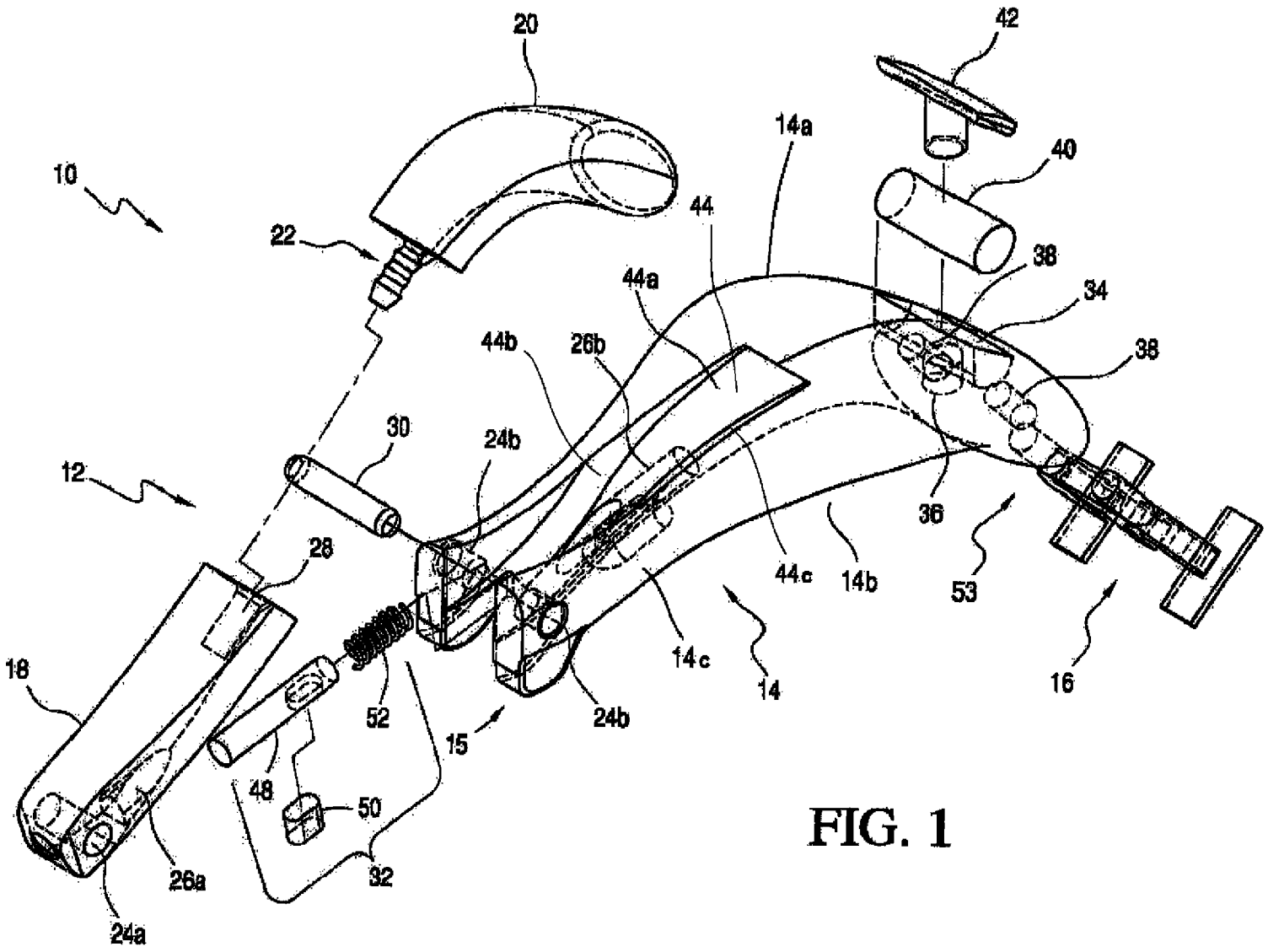
FIG. 1 is an exploded perspective view of a first configuration of an articulating handheld razor tool.
Figure 2:
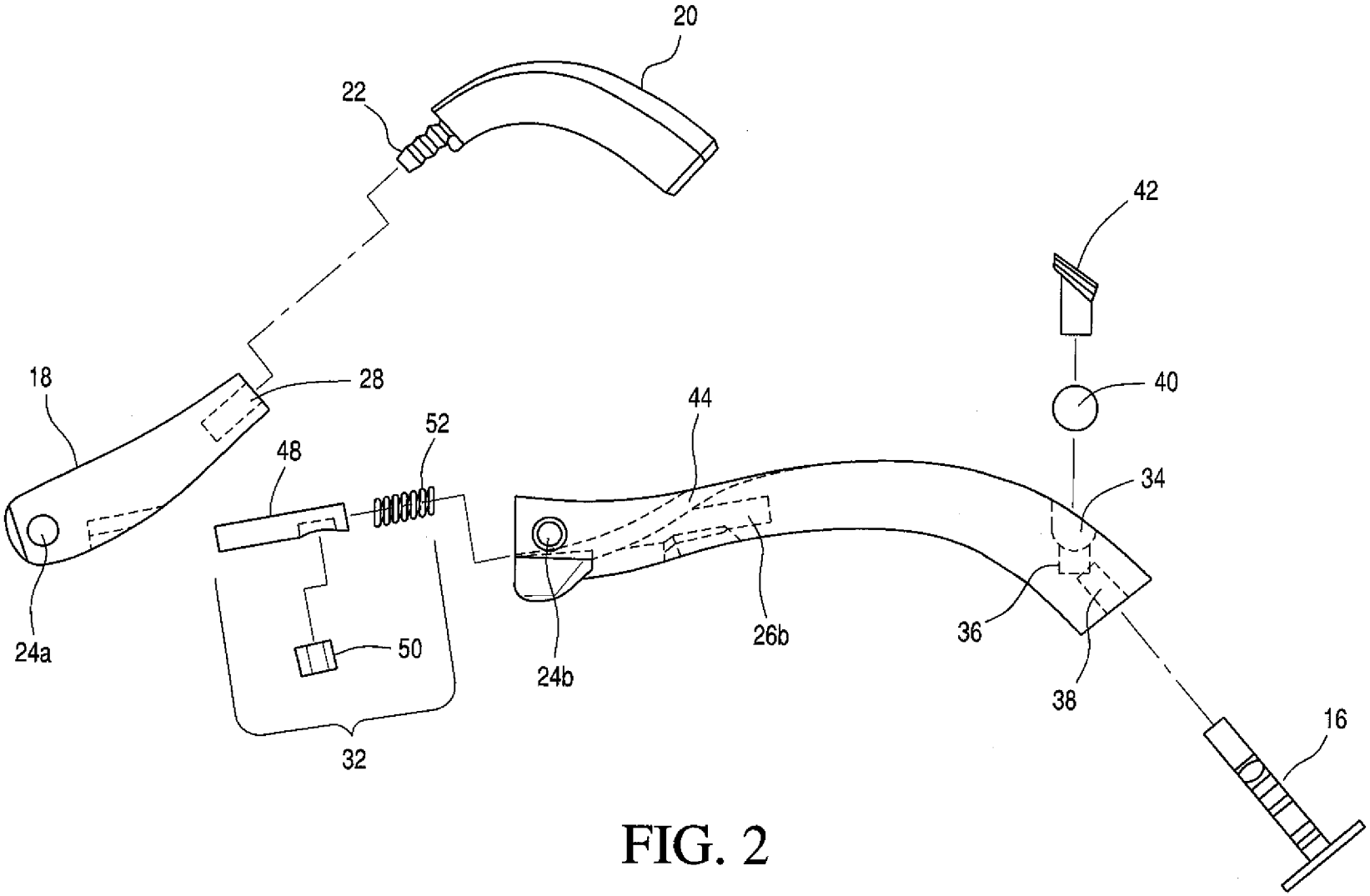
FIG. 2 is an exploded side view of the articulating handheld razor tool configuration shown in FIG. 1.
Figure 3A:
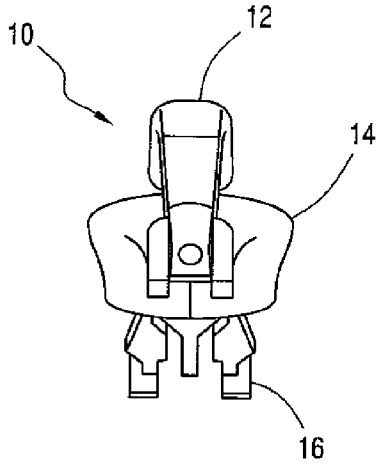
FIG. 3A is a rear view of the first configuration of the articulating handheld razor tool.
Figure 3C:
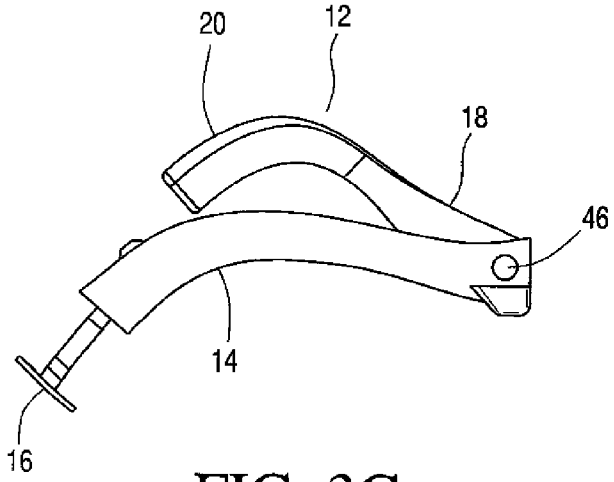
FIG. 3C is a right side view of the first configuration of the articulating handheld razor tool shown in FIG. 3A.
Figure 3B:
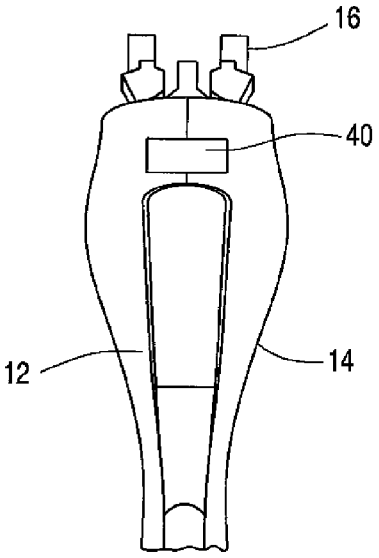
FIG. 3B is a top view of the first configuration of the articulating handheld razor tool shown in FIG. 3A.
Figure 3D:
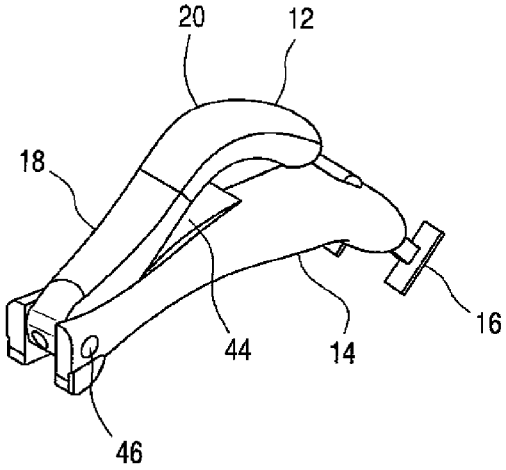
FIG. 3D is a left side perspective view of the first configuration of the articulating handheld razor tool shown in FIG. 3A.
Figure 4:
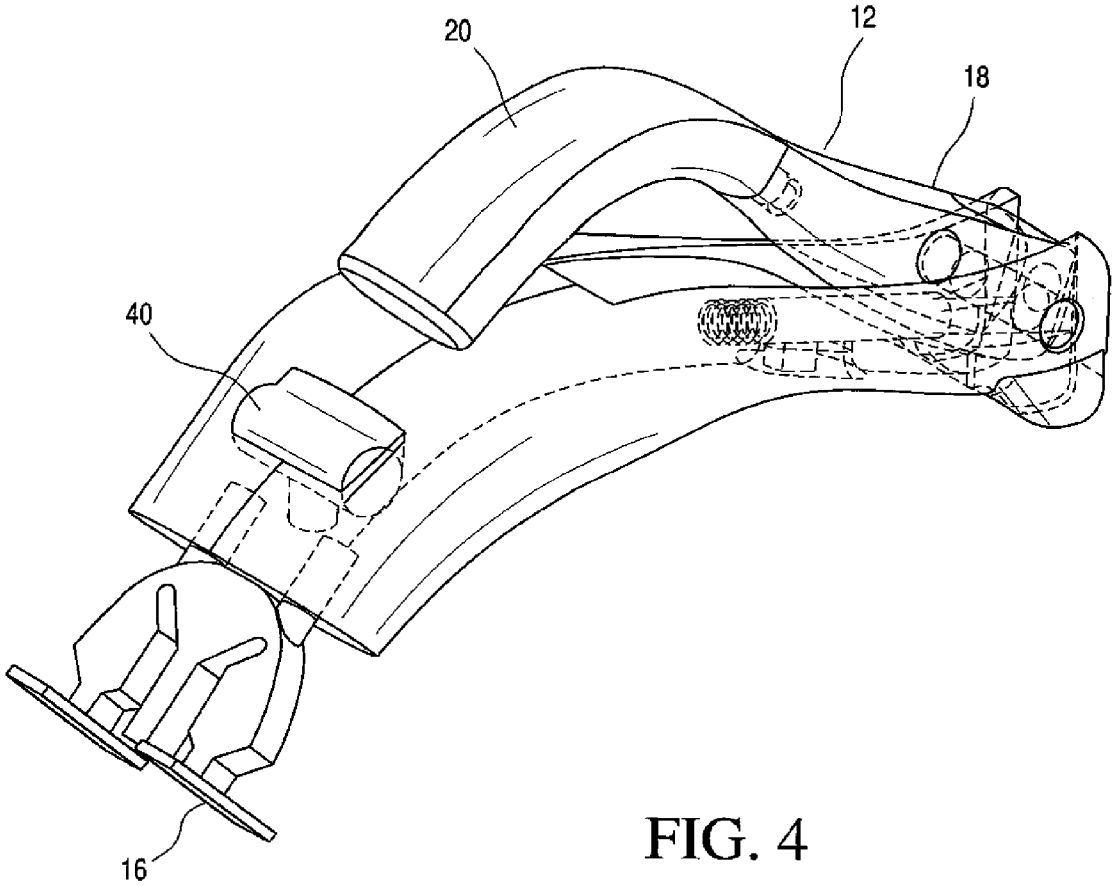
FIG. 4 is a partially transparent right side perspective view of the first configuration of the articulating handheld razor tool.
Figure 5:
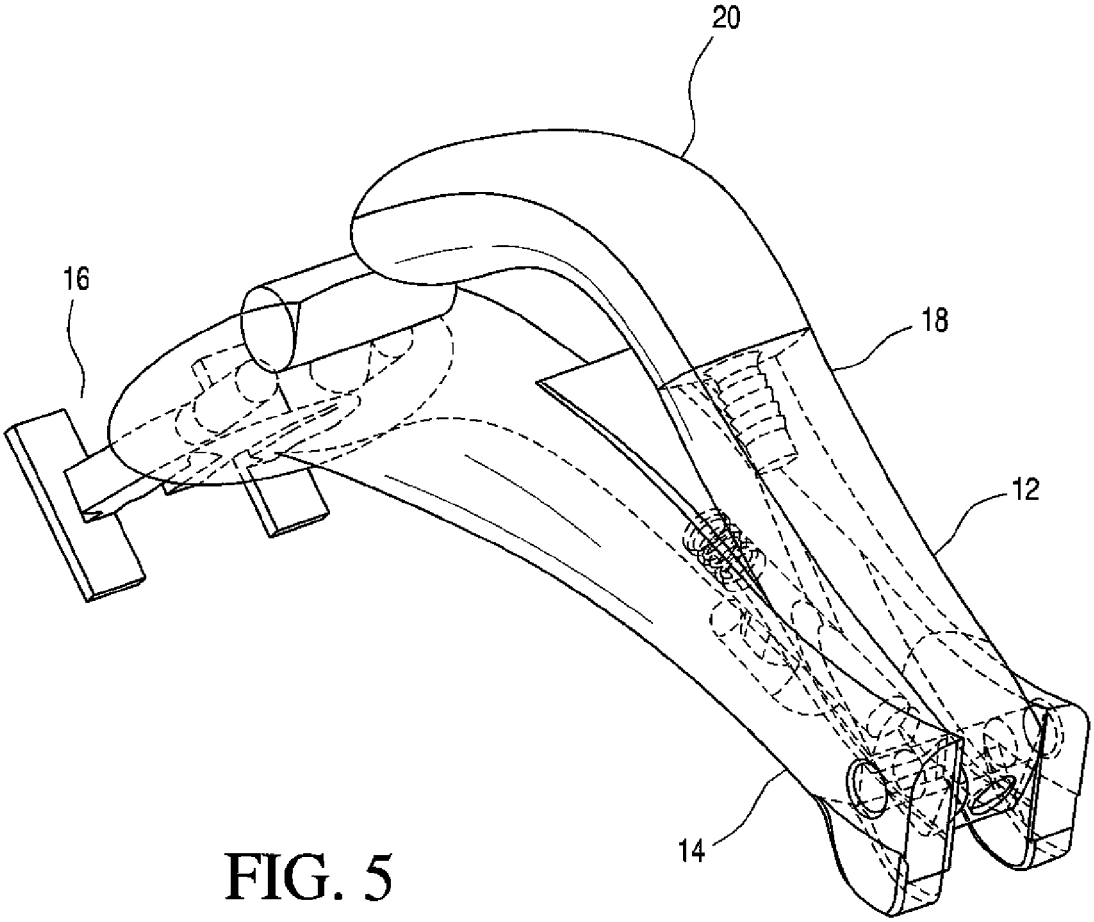
FIG. 5 is a partially transparent right rear perspective view of the first configuration of the articulating handheld razor tool.
Figure 6:
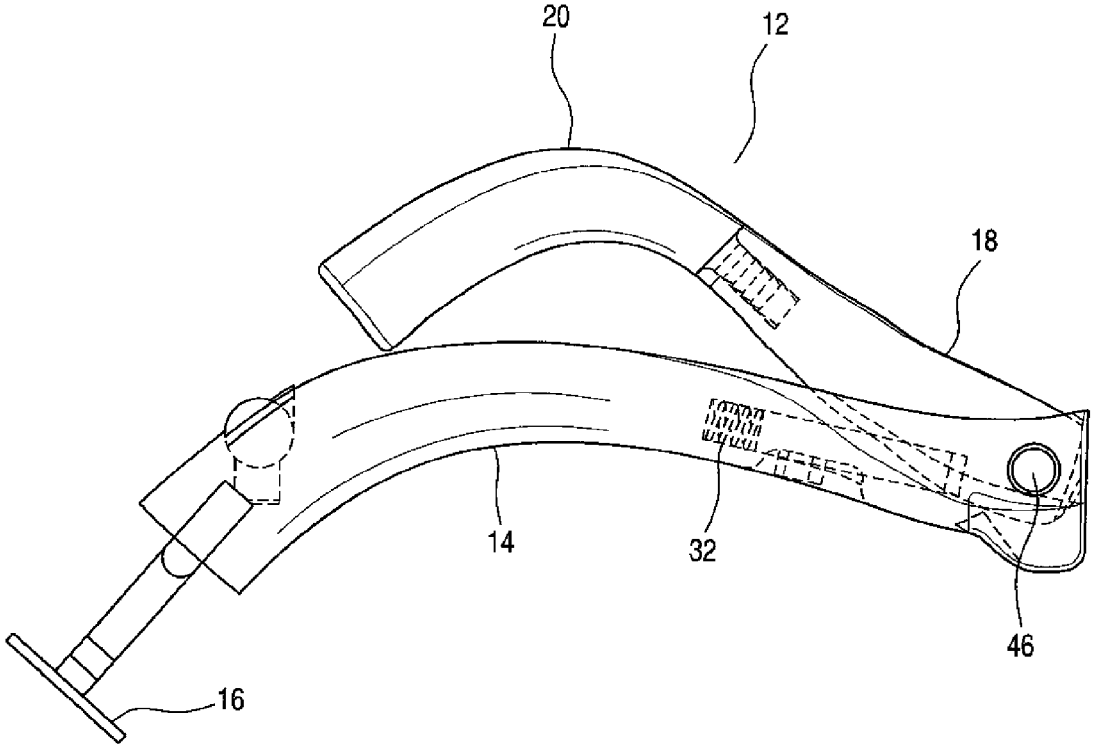
FIG. 6 is a partially transparent right side view of the first configuration of the articulating handheld razor tool.

FIGS. 1-13 show various configurations of articulating or converting handheld razor tools. These razor tools are particularly suited for self-shaving of both the face and scalp by a single user. FIGS. 1 and 2 show an exploded view of one configuration of an articulating handheld razor tool 10. This razor tool configuration includes three major sections: an articulating handle portion 12, a razor body portion 14, and a blade mount 16.

The articulating handle portion 12 includes an arm section 18 and an extender element 20 having an outer surface that is curved along its length. The arm section 18 and the extender element 20 may be separate sections that are connected by a connector 22 or integrated sections. Where the sections are separate, the connector may be a threaded or unthreaded dowel pin that is press fit into both the arm section and the extender element. Alternatively, other types of mechanical connectors or fasteners may be used. Defined within the arm section 18 are cavities 24*a*, 26*a*, 28 for placement of a hinge element 30, a locking mechanism 32 and the connector 22. The extender element 20 also may include a cavity 29 for positioning of the connector 22. The extender element 20 preferably is manufactured from one or more materials that facilitate gripping of the handle portion by a user.

The razor body portion 14 and the arm section 18 preferably are manufactured from like materials. These materials include those frequently used in razor manufacture.

Preferred materials types for handle portion, arm section and body portion include elastomeric materials having grip-enabling surface properties, such as but not limited to, ethylene methyl acrylate (EMA) copolymers, acrylics, high density polyethylenes (HDPE), styrenics (IMPS), acrylonitrile-butadiene-styrene (ABS) copolymers, poly (methylmethacrylates) (IM-PMMA), polypropylene, polycarbonate, polycaprolactam, polycaprolactone, polyurethanes, polyesters, polypropylene-ethylene propylene diene monomer (PP/EPDM), thermoplastic vulcanizates (TPV), acrylic rubber TPV, styrene-butadiene-styrene (SBS) TPV, low density polyethylene (LDPE), polyvinylchoride (PVC), very low density polyethylene (VLDPE), styrene-butadiene copolymer (SBC) elastomer compounds, styrene-butadiene-styrene (SBS) linear block copolymers, styrene-isoprene-styrene (SIS) linear block copolymers, styrene-butadiene (SB)n branched copolymers, styrene-co-ethylene-butene-styrene (SEBS) linear block copolymers, styrene-co-ethylene-propylene (SEP) diblock copolymers, styrene-co-ethylene-ethylene-propylene-styrene (SEEPS) copolymers, mineral reinforced thermoplastic ethylene-styrene (TES/SEBS), polyethersulfone (PES), glass reinforced polyethersulfone, polyphenylsulfone (PPSU), styrene-acrylonitrile (SAN), acrylic-styrene-methylmethacrylate coploymers (NAS), polydimethylsilicone (PDMS), polyurea, silicone-polyurea, segmented polyurethane (SPU), perfluoroelastomer (FFKM), perfluoroelastomer (FEPM), chlorosulfonated polyethylene rubber, fluoroelastomer, silicone room temperature vulcanizate (RTV), cast polyurethane, chloroprene rubber, hydrogenated nitrile-butadiene rubber (HNBR), nitrile rubber, silicone rubber, perfuoroelastomer compounds (FFKT), acetyl, and mixtures thereof. Aluminum (AL) and aluminum alloys and mixtures thereof also could be used.

Optionally, suitable fillers including stabilizers, colorants, pigments, dyes, clays, fragrances, or extender oils may be incorporated into elastomeric materials.

The razor body portion 14 has a convexly curved top suface 14*a*, a bottom surface 14*b*, side surfaces 14*c*, a front mounting area 53, and a rear 15, as shown particularly in FIG. 1. The razor body portion 14 also includes cavities 24*b*, 26*b*, 34, 36, 38 for positioning of the locking mechanism 32, the hinge element 30, a level 40, a level cover 42, and the blade mount 16. In addition, the razor body portion 14 includes a recess 44 for positioning of the articulating handle portion 12, as further described below. The recess 44 is defined by two opposing sidewalls 44*a*, 44*b* and a recessed surface 44*c* between the two opposing sidewalls 44*a*, 44*b*, as shown particularly in FIG. 1.

FIGS. 3A-3D and 4-6 show an assembled razor tool 10 with the articulating handle portion in a retracted position. Here, the arm section 18 of the handle portion fits at least partially within the recess 44. The handle portion 12 is capable of articulating or rotating about pivot point 46, which is formed after assembly of the hinge element 30 through cavities 24*a*, 24*b*. The locking mechanism 32 also allows the handle portion 12 to lock in place. Locking the handle portion in this manner allows for steadier shaving. The locking mechanism 32 includes a plurality of locking elements. This razor tool configuration shows one type of locking mechanism, which includes a dowel 48, a locking pin 50, and a spring 52. However, any type of locking mechanism that sufficiently restrains movement of the handle portion during shaving may be incorporated into the razor tool.

Figure 7A:
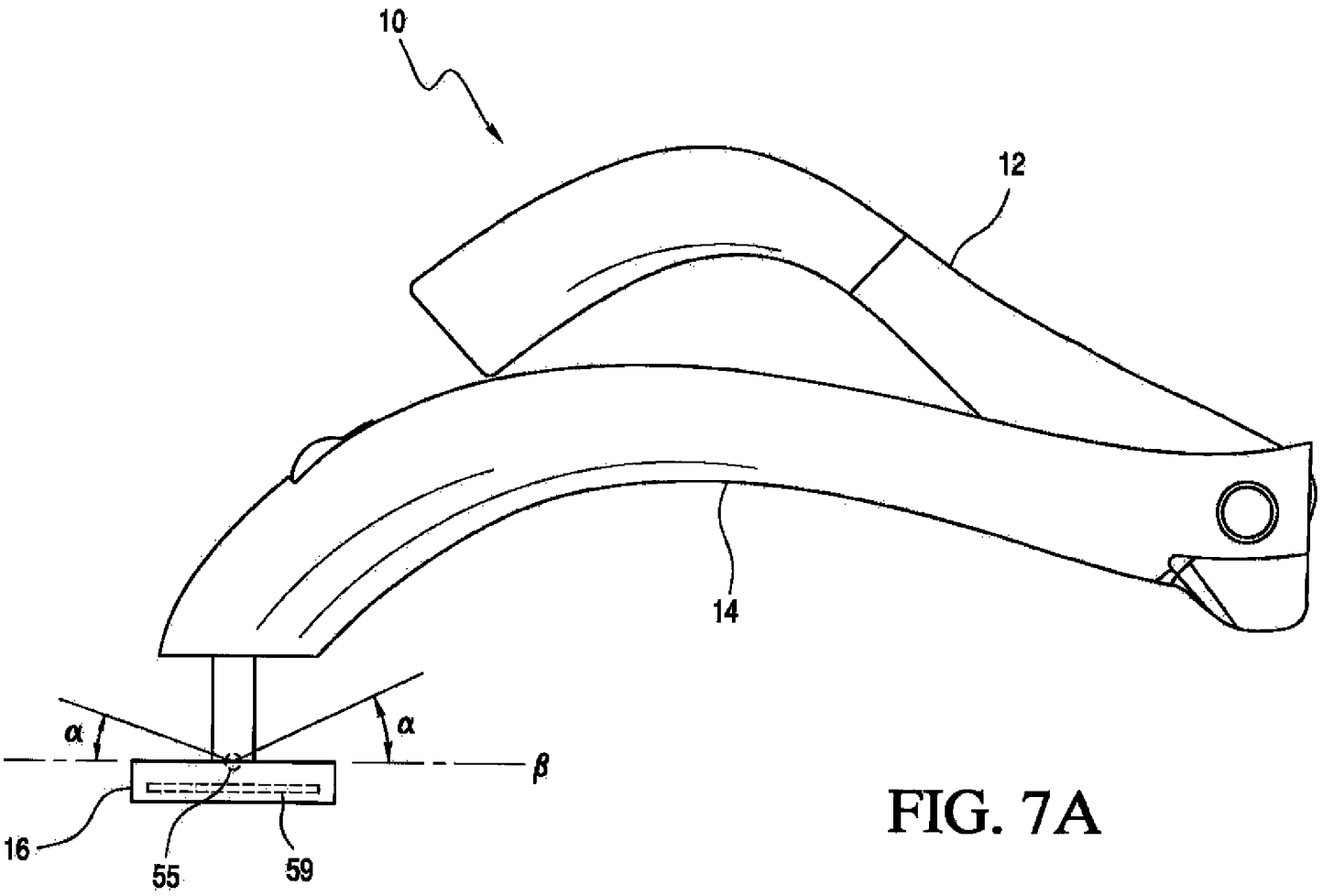
FIG. 7A is another right side view of the first configuration of the articulating handheld razor tool.
Figure 7B:
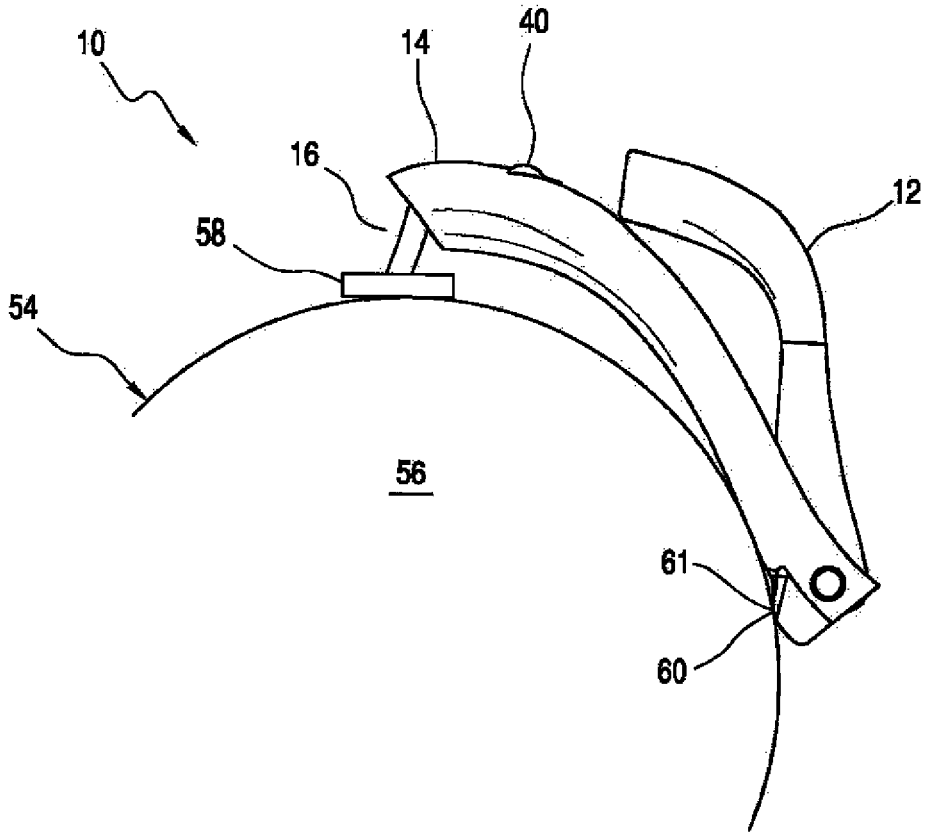
FIG. 7B shows the first configuration of the articulating handheld razor tool in use adapted for scalp shaving.

As shown in FIGS. 7A and 7B, when in the retracted position, the razor tool 10 is particularly suited for self-shaving of a user's scalp 54 after coupling of one or more razor cartridges 58, having razor blades 59 (FIG. 7A), to the blade mount 16. Razor cartridges 58 include one or more razor blades 59. Upon assembly of the tool 10, the blade mount 16 is positioned within a mounting area 53 located on the razor body portion. The blade mounting bracket configuration shown, however, is not to be construed as limiting. Rather, the configuration of the blade mounting bracket will depend upon type of razor cartridge used. In one configuration, the blade mount includes a pin (not shown) that snaps into the blade cartridge. The mount also includes a pivot point 55 that upon assembly enables a cartridge to pivot about at a specified angle $\alpha$ with respect to axis $\beta$. For one type of cartridge, the razor cartridge will pivot about ±20° with respect to axis $\beta$, e.g, upwardly toward the front and downwardly away from the front of the razor body portion 14.

With the razor tool 10 in the retracted position, a user will grasp the handle portion 12. To facilitate proper and even shaving, a level 40 optionally may be incorporated within the razor body portion 14. Therefore, a user 56 may look into a mirror (not shown) to view the level, determine the positioning of the tool 10 and the razor cartridge 58 against the scalp 54 and adjust position of the tool accordingly. In addition, this tool configuration incorporates a skid plate 60. The skid plate 60 has a curved profile 61 that facilitates positioning of the tool 10 against the scalp 54 while keeping the razor blade edge(s) in proper contact. This positioning prevents inadvertent gouging and cutting of the skin during use of the tool. Preferably, the skid plate 60 is formed of one or more materials such that the plate has a low coefficient of friction. Preferably, the skid plate and the razor body portion are manufactured from like materials. The skid plate may, however, incorporate, one or more elastomeric materials and/or lubricants that aid in friction reduction at the skid-blade interface.

Figure 8:
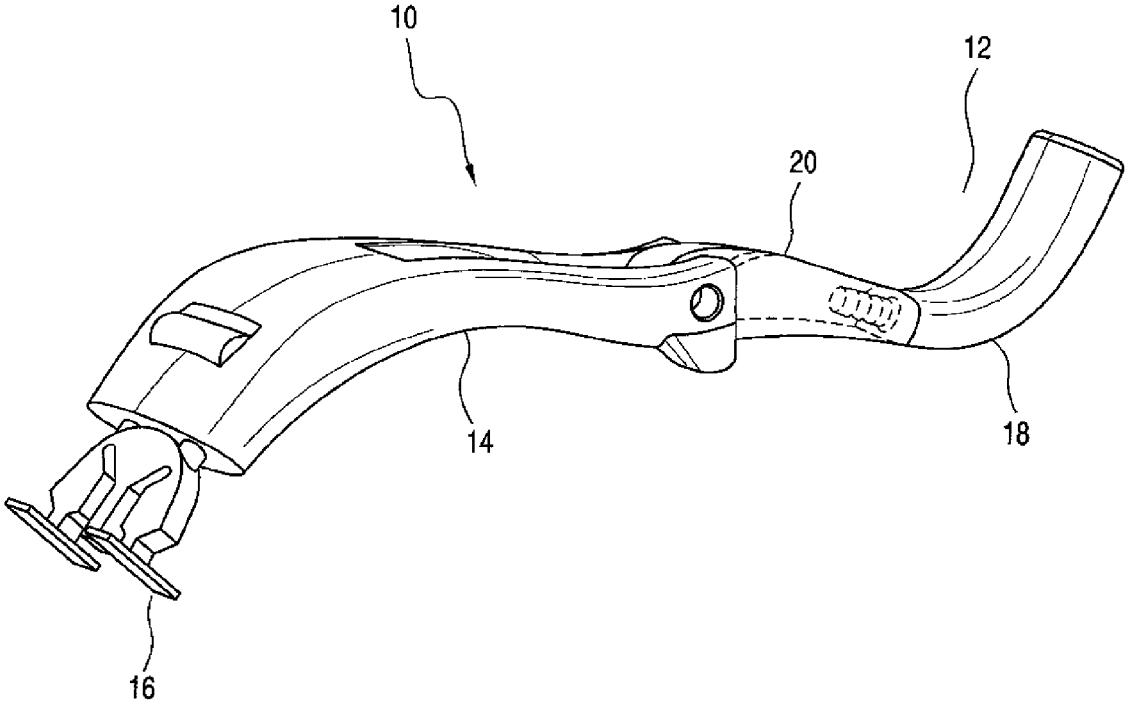
FIG. 8 is a partially transparent right side perspective view of the first configuration of the articulating handheld razor tool with the handle portion in an extended position adapted for face and limb shaving.
Figure 9:
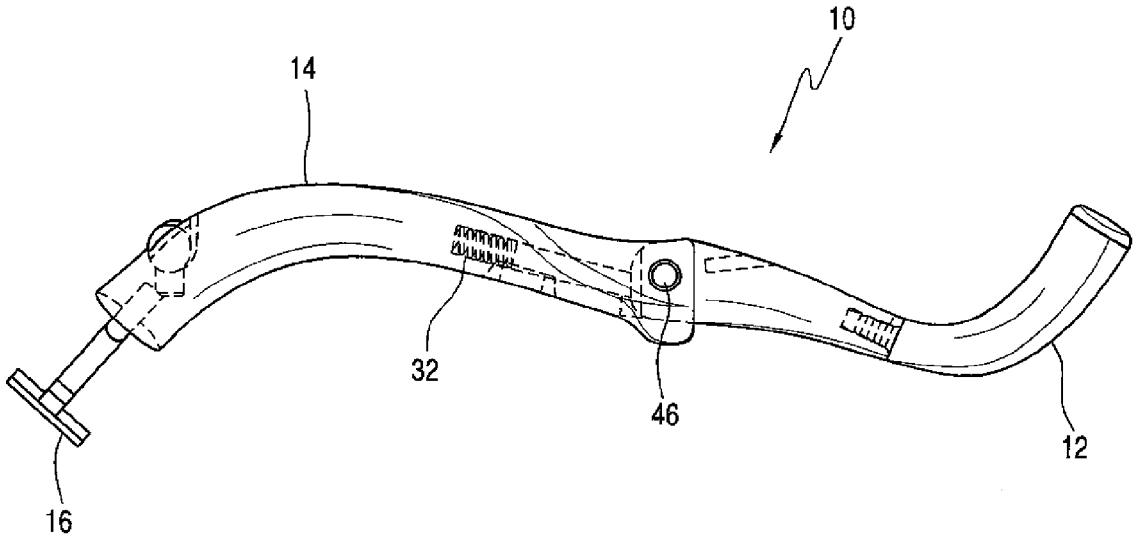
FIG. 9 is a partially transparent right side view of the first configuration of the articulating handheld razor tool with the handle portion in an extended position.

FIGS. 8-9 show the assembled razor tool 10 with the articulating handle portion in an extended position. The extender element 18 is curved in a direction opposite of the curve of the razor body 14, such that the razor body portion 14 and the handle portion 12 form an S-configuration when viewed in side elevation. In this extended position, the handle portion 12 enables one or more razor blades to extend to body surfaces that are harder to reach and/or positioned further away from the user's grip area. The extended position has particular efficacy for face shaving or for shaving limbs or other body parts that remain within the user's view during shaving.

Figure 10:
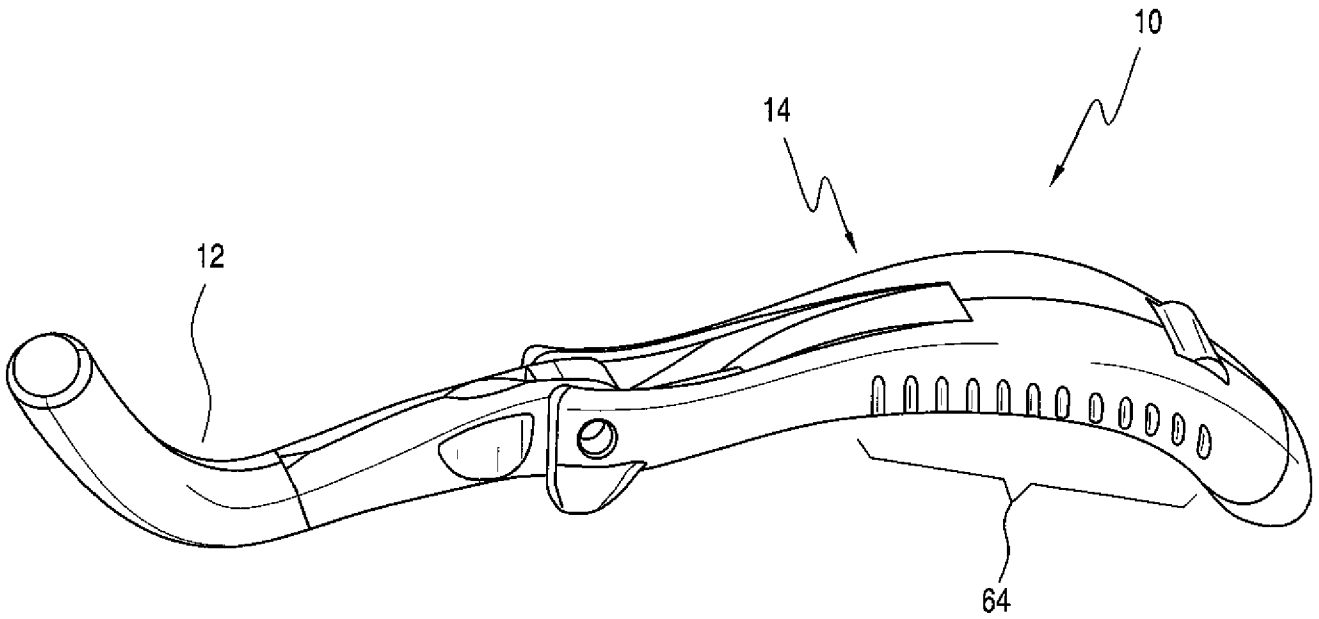
FIG. 10 is a side view of an articulating handheld razor tool that includes gripping elements.

FIG. 10 shows a razor tool 10 that incorporates gripping elements 64. The gripping elements are used to avoid slippage of user's handle during shaving. The elements are shown here as a series of spaced-apart recesses, slits or depressions formed in the razor body portions. Alternatively, gripping elements that protrude from external surfaces of the razor body portion may be incorporated into the razor tool.

Figure 11:
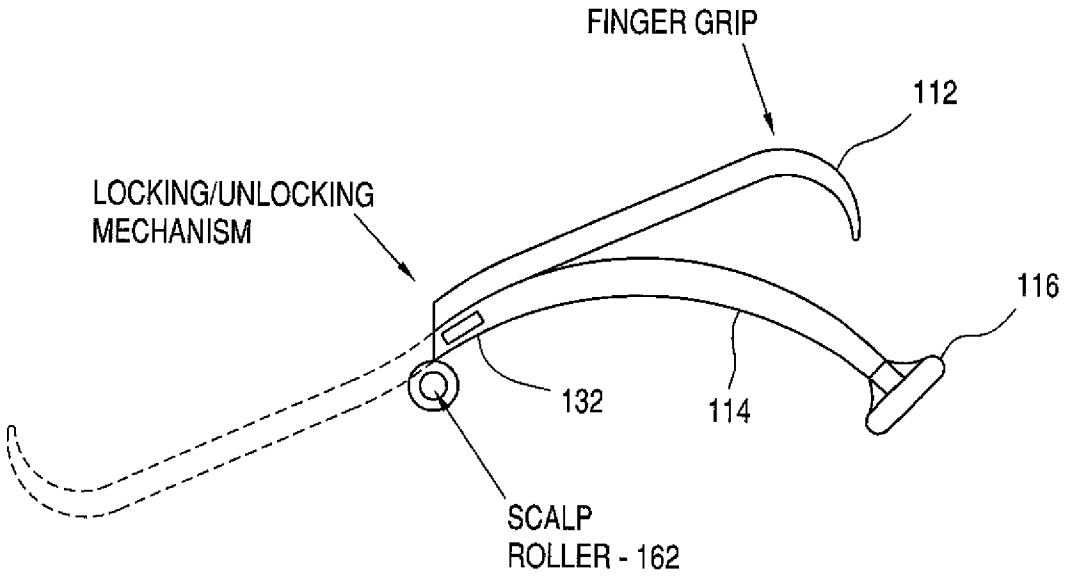
FIG. 11 is a left side view of a second configuration of an articulating handheld razor tool with the handle portion in a retracted position.
Figure 12:
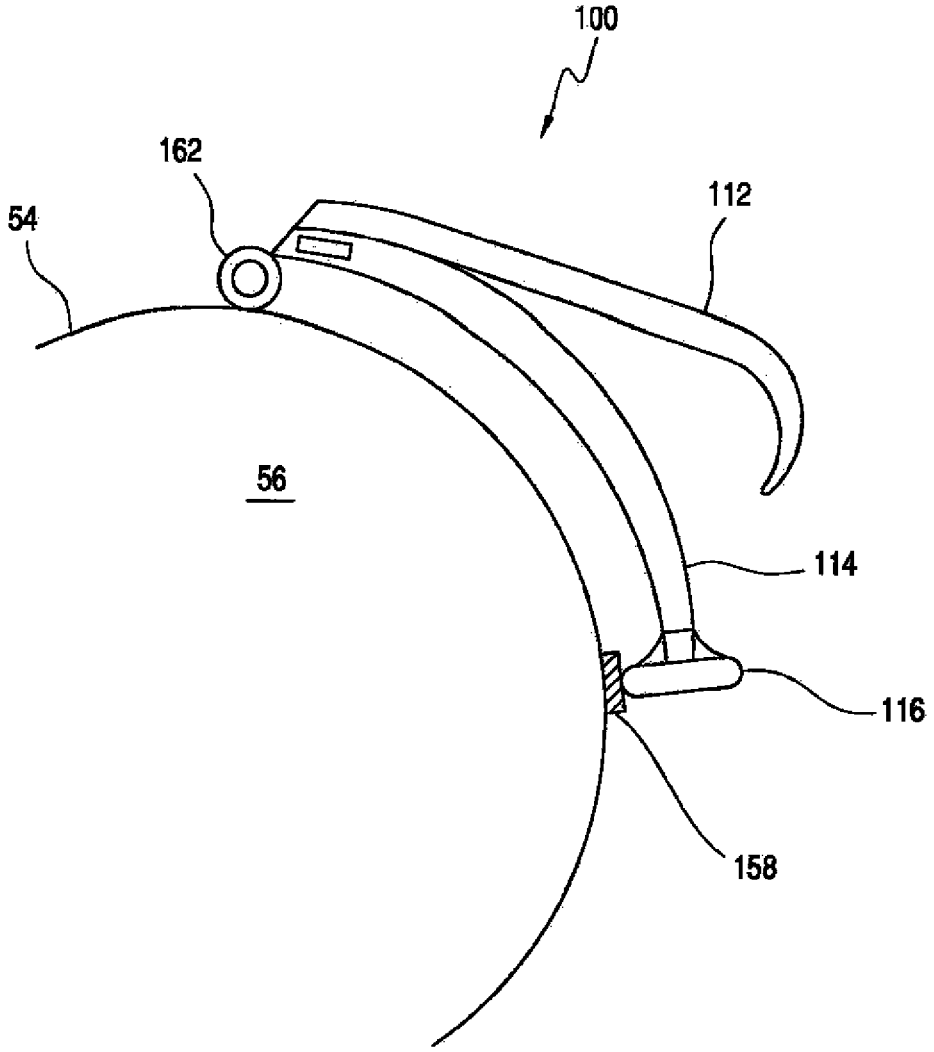
FIG. 12 shows the second configuration of the articulating handheld razor tool in use adapted for scalp shaving.
Figure 13:
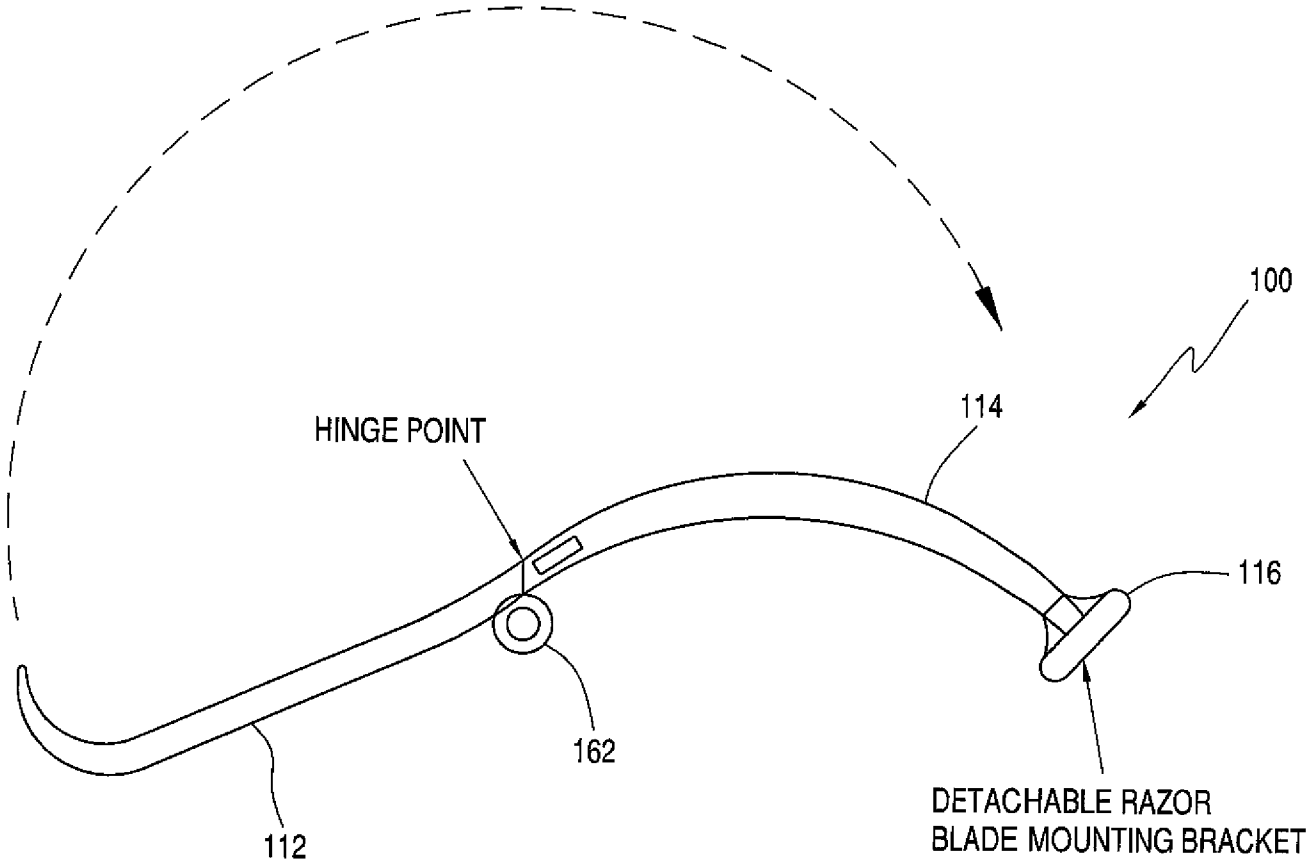
FIG. 13 is a left side view of the second configuration of the articulating handheld with the handle portion in an extended position.

FIGS. 11-13 show a second configuration of an articulating handheld razor tool 100. This configuration also includes an articulating handle portion 112 capable of articulating between retracted and extended positions, a razor body portion 114, and a blade mount 116. This tool configuration may incorporate several of the features incorporated into the first tool configuration. For example, a locking mechanism 132 is incorporated within the razor body portion 114. Instead of a skid plate, this razor tool configuration incorporates a scalp roller 162. The scalp roller 162 enables the tool to glide along the contours of the scalp 54, while keeping one or more edges of the razor blades contained in the razor cartridges 158 in proper contact with skin.

Thus, various configurations of articulating or convertible handheld razor tools are disclosed. While embodiments of this invention have been shown and described, it will be apparent to those skilled in the art that many more modifications are possible without departing from the inventive concepts herein. Moreover, the examples described herein are not to be construed as limiting. The invention, therefore, is not to be restricted except in the spirit of the following claims.

What is claimed is:

1. An articulating handheld razor tool, comprising:

a razor body portion with a first end and a second end and having a convexly curved top surface between the first end and the second end, said razor body portion top surface including a recess disposed therein, the recess being defined by two opposing sidewalls and a recessed surface between the two opposing sidewalls;

a blade mount at the first end of the razor body portion;

a handle portion, pivotably coupled to the second end of the razor body portion, articulable to an extended position from a fully retracted position, the handle portion comprising an arm section and an extender element with an end portion and a curved surface, wherein in the fully retracted position, the arm section is partially contained within the recess adjacent the two opposing sidewalls, and a portion of the arm section and a portion of the extender element are disposed over the convexly curved top surface of the razor body portion with the end portion of the extender element directly over the convexly curved top surface of the razor body, leaving an open space between the extender outer surface and the convexly curved top surface of the body.

2. The razor tool of claim 1, further comprising a locking mechanism incorporated into the razor tool to restrain movement of the handle portion.

3. The razor tool of claim 2, wherein the locking mechanism maintains the handle portion in the retracted position with respect to the razor body portion.

4. The razor tool of claim 1, further comprising a front mounting area for connection to a blade mounting bracket.

5. The razor tool of claim 1, further comprising a connector coupled to the extender element for connection of the extender element to the arm section.

6. The razor tool of claim 1, wherein the arm section is articulable with respect to a pivot incorporated in the razor body portion.

7. An articulating handheld razor tool, comprising:

a handle portion comprising an arm section and an extender element, said handle portion adapted for articulation from an extended position to a retracted position, and said extender element having an outer surface that is curved along its length;

a razor body portion coupled to the handle portion, the razor body portion having a top surface, a bottom surface, a front mounting area, a rear, and a skid plate at the rear, said razor body top surface being convexly curved along its length between the razor body front mounting area and rear, said razor body portion defining in its top surface a recess for receiving therein at least a portion of the arm section of the handle portion, the recess being defined by two opposing sidewalls and a recessed surface between the two opposing sidewalls; and a blade mounting bracket, positioned within the front mounting area, configured to hold one or more razor cartridges having at least one blade, wherein when the handle portion is in the fully open position, the razor body portion and handle portion form an S-configuration when viewed in side view in which the extender element is curved in an opposite direction from the razor body; and wherein at least a portion of the arm section is received in the recess in the top surface of the razor body portion, adjacent the two opposing sidewalls and the extender element of the handle portion is disposed over the top surface of the razor body portion when the handle portion is in the fully retracted position, leaving an open space between the curved extender surface and the convexly curved top surface of the body and with the extender element curved in substantially the same direction as the razor body.

8. The razor tool of claim 7, further comprising a locking mechanism that when engaged is adapted to maintain the handle portion in the retracted position with respect to the razor body portion.

9. The razor tool of claim 7, wherein the skid plate and razor body portion are integrally molded of one material.

10. The razor tool of claim 7, wherein the extender element and the arm section are hingedly connected.

11. The razor tool of claim 7, wherein the extender element is pivotable from its extended position to its retracted position.

12. The razor tool of claim 7, further comprising a pivot connection at the blade mounting bracket that is pivotable so that the razor cartridge attached at said pivot connection is pivotable between about −20 degrees to about +20 degrees from horizontal.

13. The razor tool of claim 7, wherein the skid plate comprises a material selected from the group consisting of: butadiene rubber, nitrile rubber, polyurethane rubber, silicone rubber, styrene butadiene rubber, and fluoroelastomer.

14. The razor tool of claim 7, wherein the handle portion comprises a material selected from the group consisting of: ethylene methyl acrylate (EMA) copolymers, acrylics, high density polyethylenes (HDPE), styrenics (IMPS), acrylonitrile-butadiene-styrene (ABS) copolymers, poly(methylmethacrylates) (IM-PMMA), polypropylene, polycarbonate, polycaprolactam, polycaprolactone, polyurethanes, polyesters, polypropylene-ethylene propylene diene monomer (PP/EPDM), thermoplastic vulcanizates (TPV), acrylic rubber TPV, styrene-butadiene-styrene (SBS) TPV, low density polyethylene (LDPE), polyvinylchoride (PVC), very low density polyethylene (VLDPE), styrene-butadiene copolymer (SBC) elastomer compounds, styrene-butadiene-styrene (SBS) linear block copolymers, styrene-isoprene-styrene (SIS) linear block copolymers, styrene-butadiene (SB)n branched copolymers,styrene-co-ethylene-butene-styrene (SEBS) linear block copolymers, styrene-co-ethylene-propylene (SEP) diblock copolymers, styrene-co-ethylene-ethylene-propylene-styrene (SEEPS) copolymers, mineral reinforced thermoplastic ethylene-styrene (TES/SEBS), polyethersulfone (PES), glass reinforced polyethersulfone, polyphenylsulfone (PPSU), styrene-acrylonitrile (SAN), acrylic-styrene-methylmethacrylate coploymers (NAS), polydimethylsilicone (PDMS), polyurea, silicone-polyurea, segmented polyurethane (SPU), perfluoroelastomer (FFKM), perfluoroelastomer (FEPM), chlorosulfonated polyethylene rubber, fluoroelastomer, silicone room temperature vulcanizate (RTV), cast polyurethane, chloroprene rubber, hydrogenated nitrile-butadiene rubber (HNBR), nitrile rubber, silicone rubber, perfuoroelastomer compounds (FFKT), and mixtures thereof.

15. The razor tool of claim 7, wherein the handle portion comprises aluminum (AL), aluminum alloys, and mixtures thereof.

16. The razor tool of claim 7, further comprising gripping elements incorporated in the razor body portion.

17. The razor tool of claim 16, wherein the gripping elements comprise protrusions that protrude from external surfaces of the razor body portion.

* * * * *